US005803302A

United States Patent [19]

Sato et al.

[11] Patent Number: 5,803,302

[45] Date of Patent: Sep. 8, 1998

[54] BAG-IN-CARTON, METHOD FOR FORMING THE BAG-IN-CARTON AND CARTON BLANK BODY

[75] Inventors: Masahisa Sato, Shibata; Yusuke Tanno, Yamamoto; Takehiko Bizen, Tokyo, all of Japan

[73] Assignees: Tohoku Ricoh Co., Ltd.; Dai Nippon Printing Co., Ltd., both of Japan

[21] Appl. No.: 620,329

[22] Filed: Mar. 22, 1996

[30] Foreign Application Priority Data

Mar. 27, 1995 [JP] Japan ..... 7-068135

[51] Int. Cl.[6] ..... B65D 5/56

[52] U.S. Cl. ..... 220/462; 220/418; 220/461

[58] Field of Search ..... 220/416, 418, 220/461, 462, 465

[56] References Cited

U.S. PATENT DOCUMENTS

| | | | |
|---|---|---|---|
| 2,412,544 | 12/1946 | Waters | 220/461 |
| 3,206,094 | 9/1965 | Humphrey et al. | 220/462 |
| 3,902,652 | 9/1975 | Malcolm | 220/462 |
| 4,890,772 | 1/1990 | Heuberger et al. | 220/462 |
| 5,197,625 | 3/1993 | Mullaney | 220/462 |
| 5,314,088 | 5/1994 | Heuberger et al. | 220/462 |

FOREIGN PATENT DOCUMENTS

| | | | |
|---|---|---|---|
| 513495 | 11/1992 | European Pat. Off. | 220/465 |
| 0 598 255 A2 | 5/1994 | European Pat. Off. . | |
| 2908654 | 9/1980 | Germany | 220/461 |

*Primary Examiner*—Gary E. Elkins
*Attorney, Agent, or Firm*—Parkhurst & Wendel, L.L.P.

[57] ABSTRACT

An inner bag is adhered by an adhesive to the substantially entire region of a pouring spout attaching panel of a carton blank, and to substantially half regions of panels bordering the pouring spout attaching panel, which are on the side of a pouring spout. The inner bag is adhered to the carton at a part which is remotest from the pouring spout and is nominal to a direction of movement made by the inner bag when air is drawn. The inner bag is adhered to the carton blank at the substantially entire region of the pouring spout attached panel, and four corners on the side of the panel, which enables the inner bag to be set up into a square shaft with high precision upon the setting-up of the carton blank.

11 Claims, 9 Drawing Sheets

BAG-IN-CARTON, METHOD FOR FORMING THE BAG-IN-CARTON AND CARTON BLANK BODY

BACKGROUND OF THE INVENTION

The present invention relates to a bag-in-carton with an inner bag adhered to an inside surface thereof, a method for forming the bag-in-carton, and a carton blank body. Bag-in-cartons (BICS) having inner bags adhered to inside surfaces thereof have been used as liquid packaging containers. The carton of a BIC is usually in the shape of a rectangular parallelopiped having a flat bottom surface and a flat top surface, and four flat side surfaces disposed between the bottom and the top surfaces. An inner bag is adhered to the inside surfaces of the four side surfaces. Such BICs are used in packaging liquids of low viscosities, such as juices, liquors, etc. When contents of such BICs are discharged through the pouring spouts, the inner bags are deformed inside the cartons as the contents are discharged.

A BIC includes an inner bag adhered to the inside surface of the carton. Depending on the position where the inner bag is adhered to the inside surface, in some cases, the inner bag cannot be well formed when the BIC is set up, or a material to be contained in the inner bag cannot be filled in the inner bag.

Depending on a position where the inner bag is adhered to the inside surface of the carton, when a content of the inner bag is discharged, the content sometimes resides in the inner bag.

SUMMARY OF THE INVENTION

An object of the present invention is to provide a bag-in-carton, a method for forming the bag-in-carton, and a carton blank body which can properly position an inner bag at adhesion positions to enable set-up of the BIC with high precision, and which can, without failure, fill a material to be contained and discharge the contained material.

A first characteristic of the present invention is a bag-in-carton comprising a closed box-shaped carton; an flexible inner bag provided in the carton for holding a content; and a pouring spout provided in a pouring spout attached surface, the inner bag being fixed to a substantially entire region of the pouring spout attached surface, and substantially half regions of a pair of opposed side surfaces bordering the pouring spout attached surface, which are on the side of the pouring spout attached surface, the inner bag being fixed to the carton at a part thereof which is remotest from the pouring spout and is normal to a direction of movement made by the inner bag when air is drawn.

A second characteristic of the present invention is a bag-in-carton as described above, wherein the part which is remotest from the pouring spout and is normal to a direction of movement of the inner bag made when air is drawn, is fixed at both ends thereof to the carton at spouts, and wherein half-cuts which are formed from an upper surface of the carton into the carton in parts which are on boundaries of the spot adhered parts of the inner bag and cross a peeling direction of the inner bag, whereby the peeling-off of the inner bag is ensured by the half-cuts.

A third characteristic of the present invention is a bag-in-carton comprising a closed box-shaped carton; an inner bag provided in the carton, for holding a content; and a pouring spout provided in a pouring spout attached surface of the carton, the inner bag being fixed to a substantially entire region of the pouring spout attached surface, and substantially half regions of a pair of opposed side surfaces bordering the pouring spout attached surface, which are on the side of the pouring spout, the pouring spout attached surface being provided in a boundary portion of the pouring spout attached surface, the inner bag being fixed by being adhered to a surface bordering a side of the pouring spout, whereby a part of the inner bag corresponding to the surface bordering a side of the pouring spout is retained undeformed when the content is discharged.

A fourth characteristic of the present invention is a carton blank body comprising a carton blank; and an flexible inner bag provided on the carton blank, the inner bag being fixed to substantially half regions of a pair of opposed panels bordering the pouring spout attached surface panel, which are on the side of the pouring spout surface panel, the inner bag being fixed by being spot-adhered to an entire region of a panel on the side opposed to the pouring spout attached surface of the carton blank.

A fifth characteristic of the present invention is the above-described carton blank body, wherein half-cuts formed from an upper surface of the carton into the carton are provided in parts of the carton blank which are boundaries of the spot-adhered parts of the inner bag and normal to at least a direction of peeling of the inner bag, whereby the peeling-off of the inner bag is ensured by the half-cuts.

A sixth characteristic of the present invention is a method for producing a bag-in-carton comprising: the steps of setting up into a box a carton blank body which comprises a carton blank and an inner bag provided on the carton blank, and in which the inner bag is fixed to a substantially entire region of a pouring spout attached panel of a carton blank and substantially half regions of a pair of side panels bordering the pouring spout attached surface panel, which are on the side of the pouring spout attached panel, and the inner bag is fixed by being adhered to an entire region of a panel on the side opposed to the pouring spout attached surface panel of the carton blank; attaching the pouring spout in the pouring spout attached surface panel; and peeling the inner bag off from the panel opposed to the pouring spout attached surface panel, leaving a part thereof which is remotest from the pouring spout and is normal to a direction of movement of the inner bag made when air is drawn.

According to the first characteristic of the present invention, the inner bag is fixed to the carton by a spot adhesion at a part thereof which is remotest from the pouring spout and is normal to a moving direction of the inner bag, whereby when the air in the inner bag is drawn through the pouring spout for loading a material to be contained, the remotest part of the inner bag from the pouring spout remains undeformed until the air is drawn out. Then the remotest part from the pouring spout peels off the carton and is moved to the pouring spout. In the air draw, no air resides in the inner bag, and the air draw can be perfect.

According to the second characteristic of the present invention, half-cuts are formed in parts which are boundaries of the spot adhered parts of the inner bag and are normal to a direction of peeling of the inner bag, whereby the half-cuts ensure the peeling of the inner bag.

According to the third characteristic of the present invention, the inner bag is fixed by being adhered to the pouring spout attached surface, and a surface bordering a side of the pouring spout, whereby when the content is discharged, the inner bag can be supported remaining undeformed near the pouring spout.

According to the fourth embodiment of the present invention, the inner bag is fixed by being adhered to the substantially entire region of the pouring spout attached surface panel of the carton blank, and to four corners on the side of the panel opposed to the pouring spout attached surface panel, whereby when the carton blank is set up, the inner bag can be formed into a square shaft with good precision.

According to the fifth characteristic of the present invention, half-cuts are provided in parts which are boundaries of the spot-adhered parts of the inner bag and are normal to a peeling direction of the inner bag, whereby the half-cuts ensure the peeling of the inner bag.

According to the sixth characteristic of the present invention, the carton blank can be set up with good precision, and the inner bag is fixed to the carton at a part thereof which is remotest from the pouring spout, whereby air residue can be prevented.

PREFERRED EMBODIMENTS OF THE INVENTION

Figure 4A:
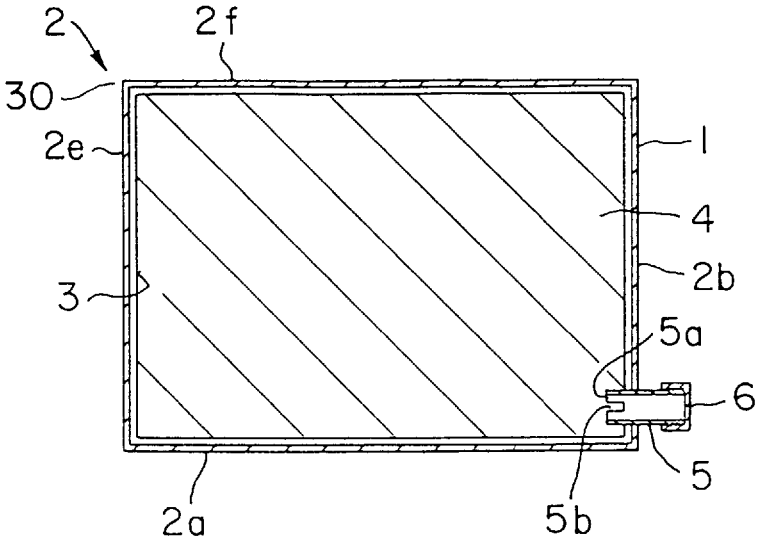
FIG. 4A is a sectional view of the BIC.
Figure 4B:
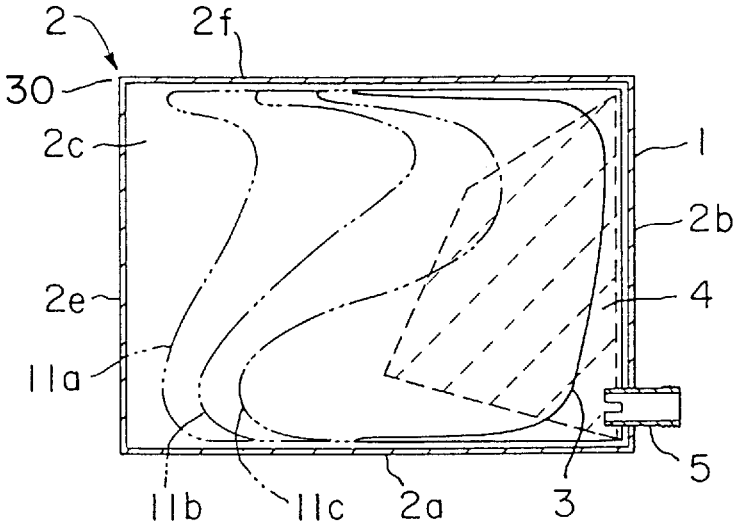
FIG. 4B is a sectional view of the BIC.
Figure 5:
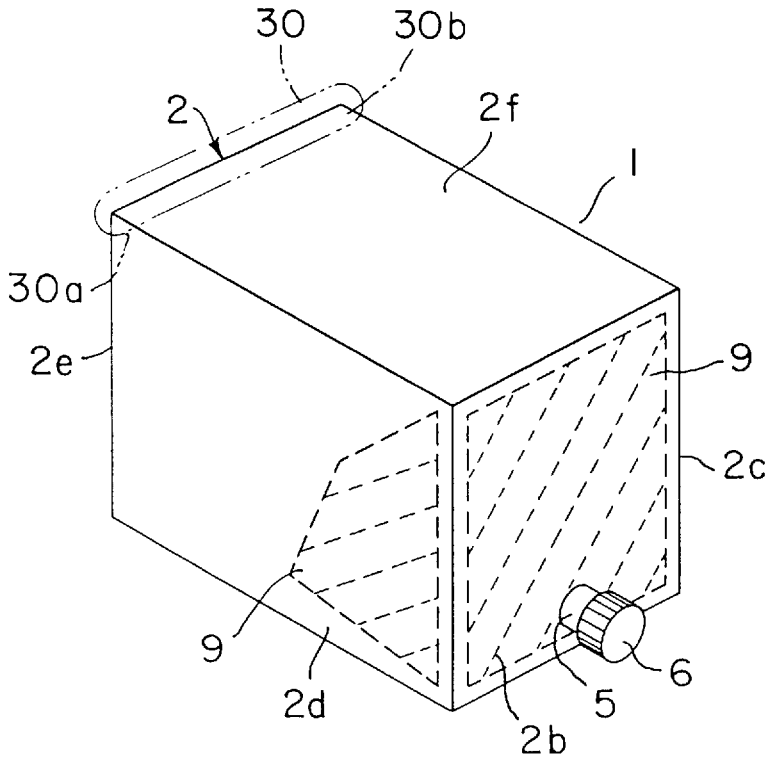
FIG. 5 is a perspective view of the BIC.

An embodiment of the present invention will be explained with reference to the drawings attached hereto. FIGS. 1 to 5 are views of the embodiment. First, with reference to FIGS. 4A and 4B, the bag-in-carton (BIC) will be briefed. FIG. 4A shows the state of the bag-in-carton filled with a content, and FIG. 4B shows a state of the BIC with a content drawn out. FIG. 5 is a schematic perspective view of the BIC. In FIG. 4A and B, and FIG. 5, the BIC 1 includes a closed box-shaped carton 2 as an outer container, and an flexible inner bag 3 housed inside the carton 2. The inner bag 3 contains a liquid 4, such as ink or others. The carton 2 is a rectangular parallelopiped, and has a flat rectangular bottom surface 2*a*, a flat front surface, flat opposed side surfaces, a flat back surface, and a flat top surface 2*f*.

A pouring spout 5 is inserted in a lower end of the front surface (pouring spout attached surface) 2*b* in communication with the interior of the inner bag 3 and is closed by a cap 6. The pouring spout 5 has a cylindrical portion 5*a*, and a channel 5*b* is formed in a side of the cylindrical portion 5*a* in the form of a groove for passing a contained liquid 4. The channel 5*b* can let out the content 4 even when the inner bag 3 blocks the tip of the cylindrical portion 5*a*.

The inner bag 3 has parts adhered to the inside surface of the carton 2 to be stationary.

Figure 1:
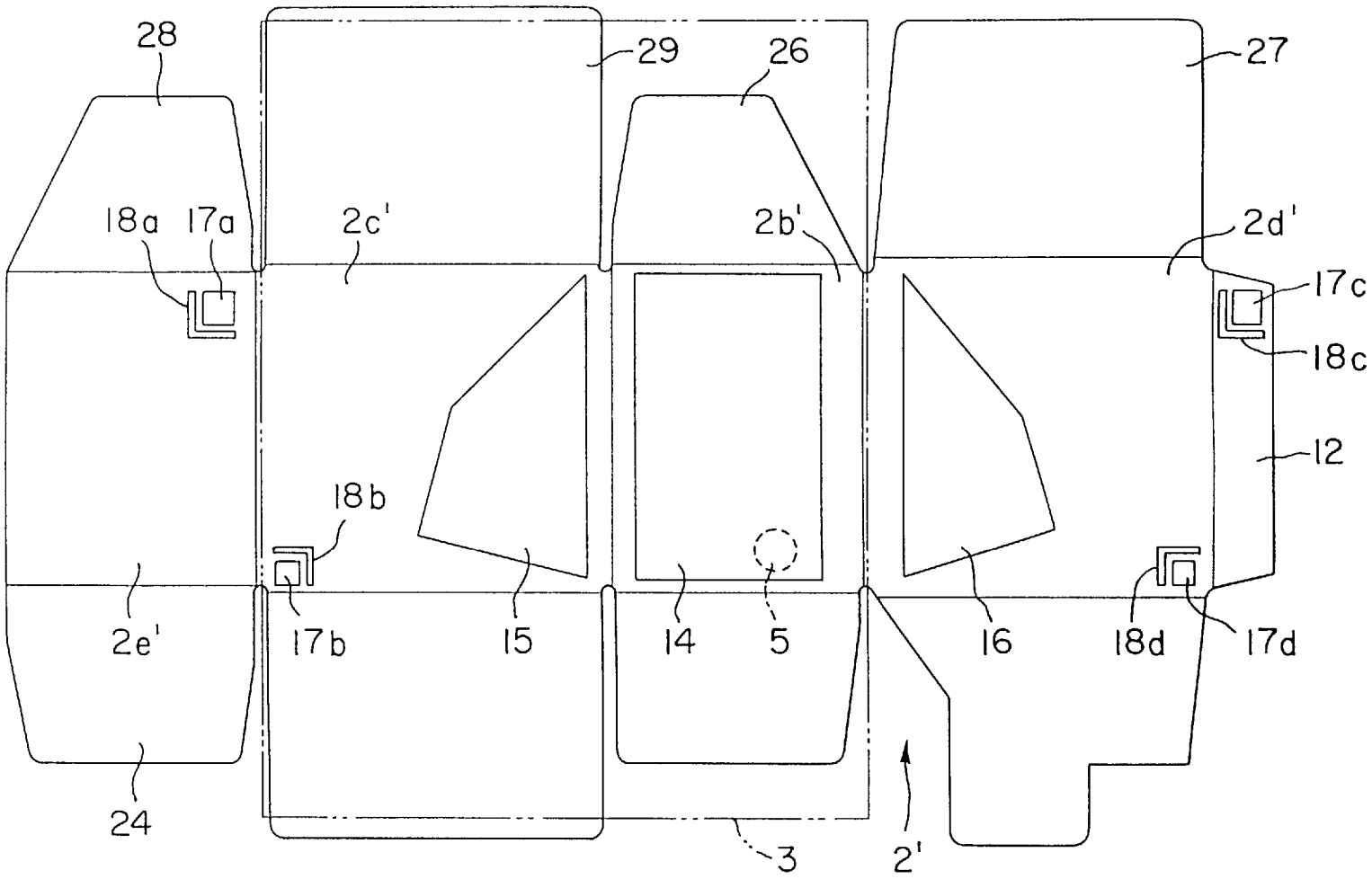
FIG. 1 is a plan view of the carton blank body before set up into the BIC according to the present invention.
Figure 2:
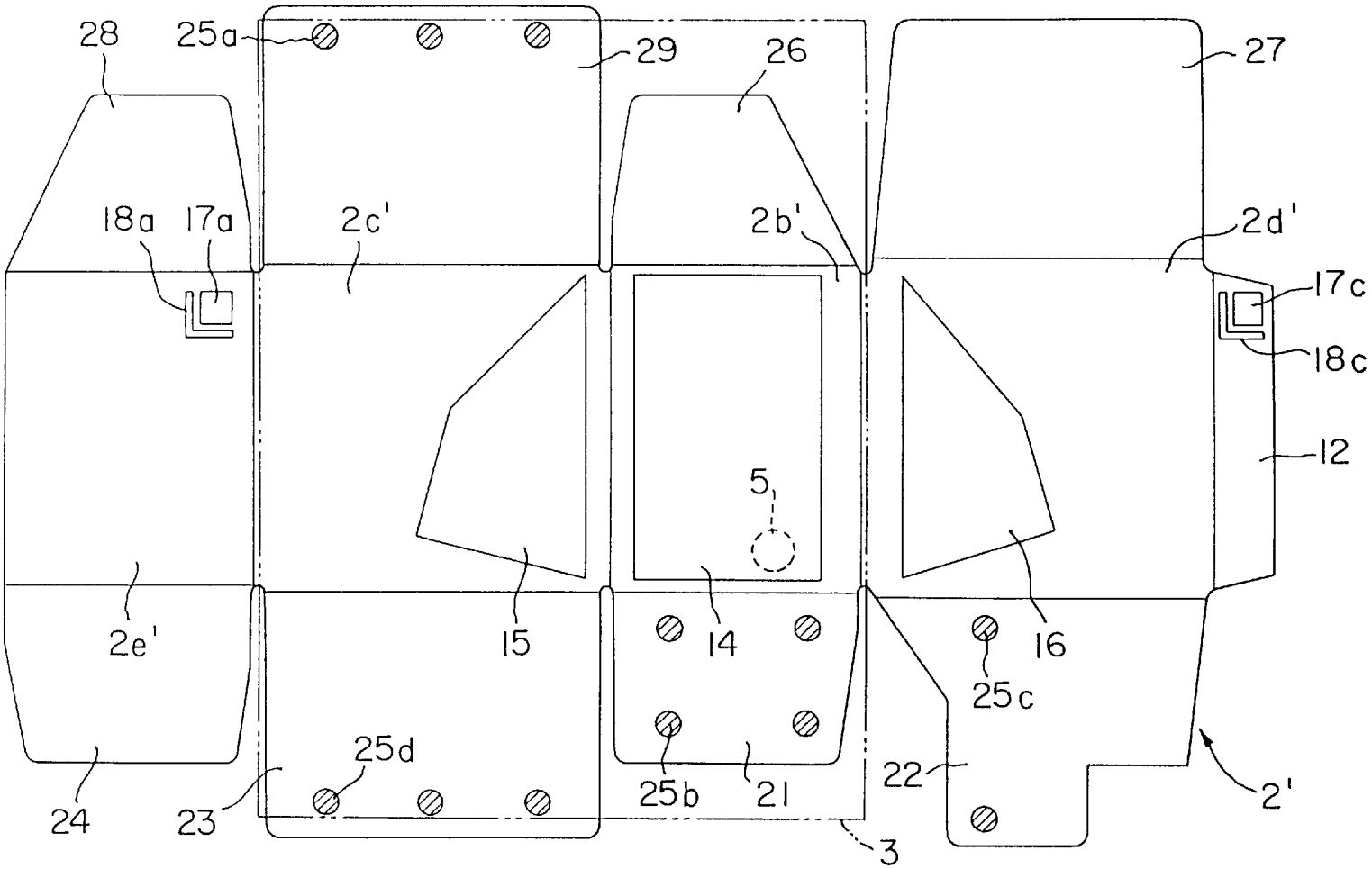
FIG. 2 is a view showing the adhesion positions before a material to be contained is loaded into the BIC.
Figure 3:
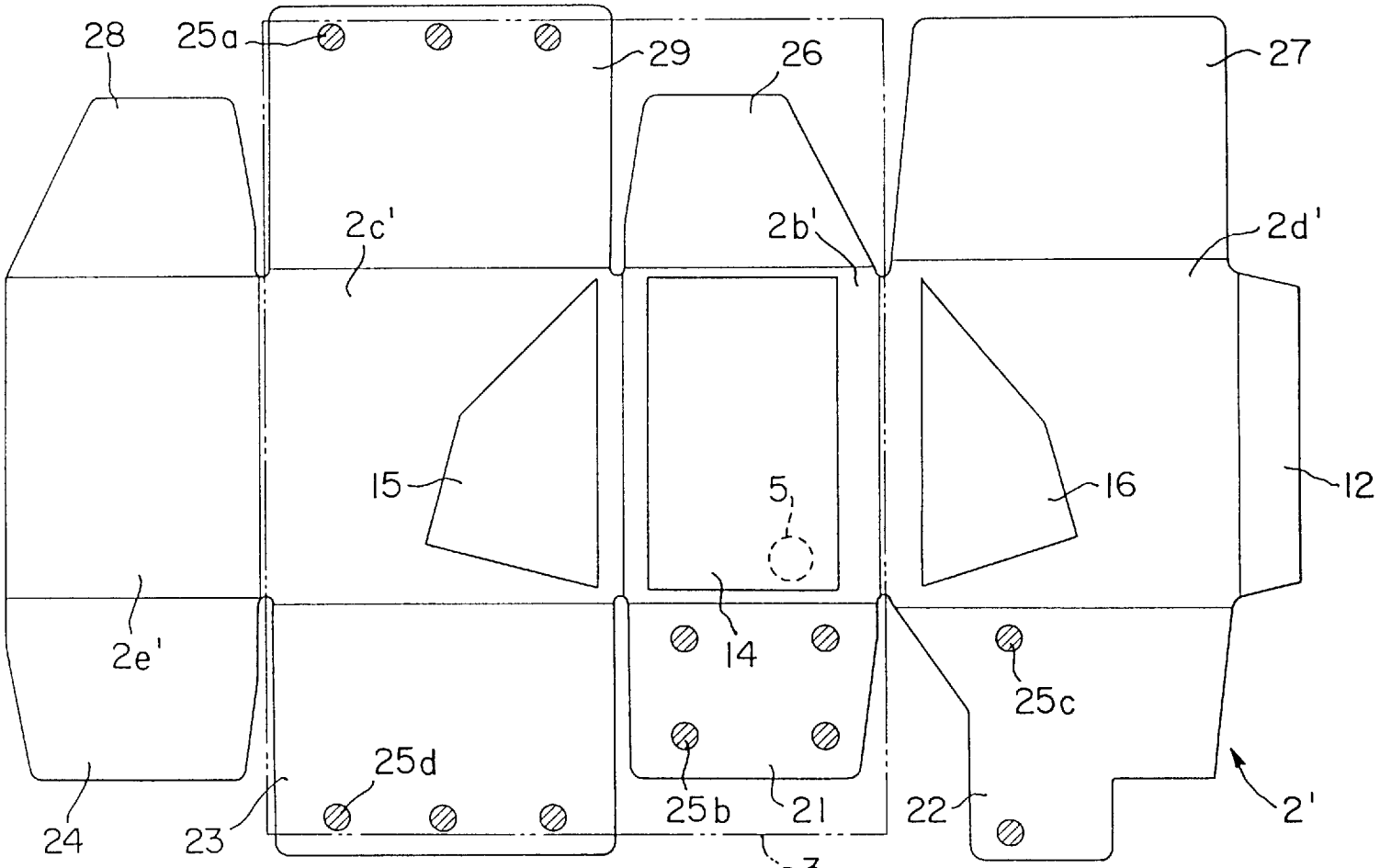
FIG. 3 is a view showing the adhesion positions of the inner bag after a material to be contained is loaded into the BIC.

That is, as will be described later, the inner bag 3 is adhered stationary to substantially the entire front surface 2*b* (with the pouring spout inserted in) of the carton 2 and to substantially a half of that of the opposed side surfaces 2*c*, 2*d* bordering the front surface, which is on the side of the pouring spout 5 (FIGS. 1 to 3).

Then with reference to FIGS. 1 to 3 the inner bag adhesion positions will be explained in the steps of producing the BIC.

First, a paper carton blank 2' in the shape shown in FIG. 1 is prepared. An inner bag 3 made of plastics is arranged on the carton blank 2'. Then the inner bag 3 is adhered to the carton blank 2' with an emulsion, and a carton blank body is prepared.

FIG. 1 shows application regions to which the emulsion is applied. That is, in FIG. 1, the emulsion is applied to a substantially entire region 14 of a panel 2*b'* (corresponding to the front surface 2*b*) of the carton blank 2', and substantially half regions 15, 16 of panels 2*c'*, 2*d'* (corresponding respectively to the side surfaces 2*c*, 2*d*), which are on the side of the pouring spout 5.

The emulsion is applied further to an application region 17*a* of a panel 2*e'* (corresponding to the back surface 2*e*) which is an upper part of the side of the panel 2*e'*, which is nearer to a panel 2*c'*, an application region 17*b* of a panel 2*c'* which is a lower part of the side of the panel 2*c'*, which is nearer to the panel 2*e'*, an application region 17*c* which is an upper part of an overlap-width panel 12 which borders along the panel 2*d'*, and an application region 17*d* which is a lower part of an overlap-width panel 12 of the panel 2*d'*.

The emulsion is applied to the regions 17*a*, 17*b*, 17*c*, 17*d*, whereby the inner bag 3 can be fixedly spot-adhered to the carton blank 2' at the four corners on the side of the panel 2*e'*, which is to be opposed to the panel 2*b'* corresponding to the front surface (with the pouring spout inserted in). The inner bag 3 is thus fixed by the emulsion at the substantially entire region 14 of the panel 2*b'*, and the application regions 17*a*, 17*b*, 17*c*, 17*d*, so that when the carton blank 2' is set up into a box, the inner bag 3 can be formed into a square shaft with good precision. Accordingly a BIC with good precision can be produced.

The application regions 17*a*, 17*b*, 17*c*, 17*d* may be moved to positions which are near to the application positions on the panels bordering along their respective panels on which the application regions 17*a*, 17*b*, 17*c*, 17*d* are provided. To be specific, the application region 17*a* may be moved to an upper part of the side of the panel 2*c'*, which borders the panel 2*e'*, and the application region 17*b* may be moved a lower part of the side of the panel 2*e'*, which borders the panel 2*c'*.

The application regions 17*a*, 17*b*, 17*c*, 17*d* have a square shape, and half-cuts 18*a*, 18*b*, 18*c*, 18*d* in an L-shape are formed from the upper surface to the inside in the parts of the borders of the application regions, which are on the side of the pouring spout 5. The half-cuts 18*a*, 18*b*, 18*c*, 18*d* are located at the parts which, when the inner bag 3 is peeled off, intersect a peeling direction of the inner bag 3 for stopping breakage of the carton 2 which accompanies peeling of the inner bag 3.

The emulsion is exemplified by vinyl acetate-based, acryl copolymer-based, vinyl acetate-acrylcopolymer-based, modified acrylate copolymer-based, etc. emulsion-type adhesives.

Then, the carton blank 2' is set up into a box, and a hole for the pouring spout 5 to be inserted in is formed in a part of the panel 2*b'* which is near the border of the bottom panel 2*a*, and the pouring spout 5 is attached. In this case, as shown in FIG. 2, the inner bag 3 is peeled off from those 17*b*, 17*d* of the emulsion application regions 17*a*, 17*b*, 17*c*, 17*d*. Concurrently therewith the inner bag 3 is adhered to the panel 21 of the carton blank 2' by hot-melt at spots. Hot-melt application regions 25*b* on the panel 21 are shown in FIG. 2. In FIG. 2, the panel 21 and the panel 24 are folded, and then the panel 21 is secured to a panel 22 by hot-melt application regions 25*c*. Further, the panel 22 is secured to a panel 23 by hot-melt application regions 25*d*. The bottom surface 2*a* is thus formed. The hot-melt is exemplified by ethylene-vinyl acetate copolymer-based, polyvinyl acetate-based, polyamide-based, styrene-butadiene copolymer-based, styreneisoprene copolymer-based, polyisobutylene-based, polyester-based, etc. hot-melt type adhesives.

The inner bag 3 is thus fixed to the panel 21, and the panel 21 is fixed to the panels 22, 23, so that the inner bag 3 is fixed to the bottom surface 2*a*, which borders the side of the pouring spout attached panel 2*b* where the pouring spout 5 is located. The bottom surface 2*a* can retain its shape without deformation. As a result, when a content is discharged through the pouring spout 5, the inner bag 3 can retain its shape near the pouring spout 5. Thus, the inner bag 3 is free from deformation near the pouring spout 5 to adversely leave a content.

In FIG. 2, the panels 26, 27, 28, 29 are folded with the panel 29 located top, and the panel 29 is fixed by the hot-melt applied to hot-melt application regions 25*a* on the panel 29, and the top surface 2*f* is formed.

Next, the carton blank 2' is thus set up, and then a material to be contained is loaded into the set-up BIC 1.

The adhered state of the inner bag 3 before a content 4 is loaded is shown in FIG. 2, and the adhered state of the inner bag 3 after the content 4 is loaded is shown in FIG. 3.

Figure 9:
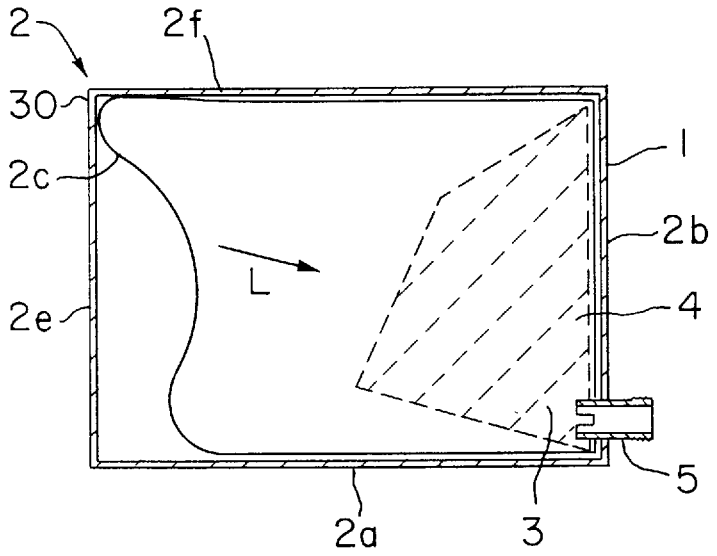
FIG. 9 is a sectional view of the BIC while the air in the inner bag is drawn.

As described above, when the carton blank is set up, those 17*b*, 17*d* of the emulsion application regions 17*a*, 17*b*, 17*c*, 17*d* are peeled off the inner bag 3, and as shown in FIG. 2, the inner bag 3 is adhered to the inside surface of the carton 2 at the panel 2*e*, and the emulsion application regions 17*a*, 17*c* on the overlap-width panel 12. Thus, because the inner bag 3 is adhered to the inside surface of the carton blank 2' at the panel 2*e'* and the emulsion application regions 17*a*, 17*c* on the overlap-width panel 12, the inner bag 3 is fixed to the carton 2 at a part 30 thereof which is the remotest from the pouring spout 5 and crosses a moving direction L of the inner bag 3 (FIG. 9). In this case, both ends 30*a*, 30*b* of the part 30 are fixed to the carton 2 by the emulsion application regions 17*a*, 17*c*.

Then, when a material to be contained is loaded, the air in the inner bag 3 is drawn out through the pouring spout 5. The air draw moves the inner bag 3 in the moving direction L of the inner bag to deform the inner bag 3, and a moved part of the inner bag 3 is withdrawn into a fixed part of the inner bag 3 (FIG. 9).

In this case, because the part 30, which is the part of the inner bag 3 remotest from the pouring spout 5 and is normal to the moving direction L of the inner bag 3, is fixed to the carton 2, even when the inner bag 3 is deformed, the part 30, which is remotest from the pouring spout 5, remains adhered to the inner bag 3, undeformed. Then the part 30 of the inner bag 3 is peeled off the emulsion application regions 17*a*, 17*c* to be moved toward the pouring spout 5.

The part 30 of the inner bag 3, which is remotest from the pouring spout 5, remains undeformed until the last, whereby when the interior of the inner bag 3 is drawn, the air draw can be perfect without air residue.

After the air draw is over, the material to be contained 4 is loaded into the inner bag 3 through the pouring spout 5, and the adhered state of the inner bag 3 is as shown in FIG. 3.

When the BIC 1 filled with the content 4 is used, as shown in FIGS. 4A and 4B, the BIC 1 is set upright on a printer or others with the pouring spout 5 connected to suction means (not shown) to suck the content 4 through the pouring spout 5. At this time, because a substantially half of the inner bag 3 on the side opposite to the pouring spout 5 is not adhered to the inside surface of the carton 2, the movable part is deformed as indicated by the two-dot chain lines 11*a*, 11*b*, 11*c*, etc. in FIG. 4B as the content 4 is sucked out, whereby the content 4 can be discharged without charging air into the inner bag. Finally the movable part of the inner bag 3 is withdrawn into the fixed part of the inner bag 3, which is a substantially half of the inner bag and adhered to the inside surface of the carton, letting out almost all of the content through the pouring spout 5.

Next, another embodiment of the present invention will be explained with reference to FIGS. 6 to 8. The embodiment shown in FIGS. 6 to 8 is substantially the same as the embodiment shown in FIGS. 1 to 5 and differs from the latter only in the positions of the emulsion application regions on the panel 2*b'* and the positions of the panels constituting the bottom surface 2*a* and the top surface 2*f*.

Figure 6:
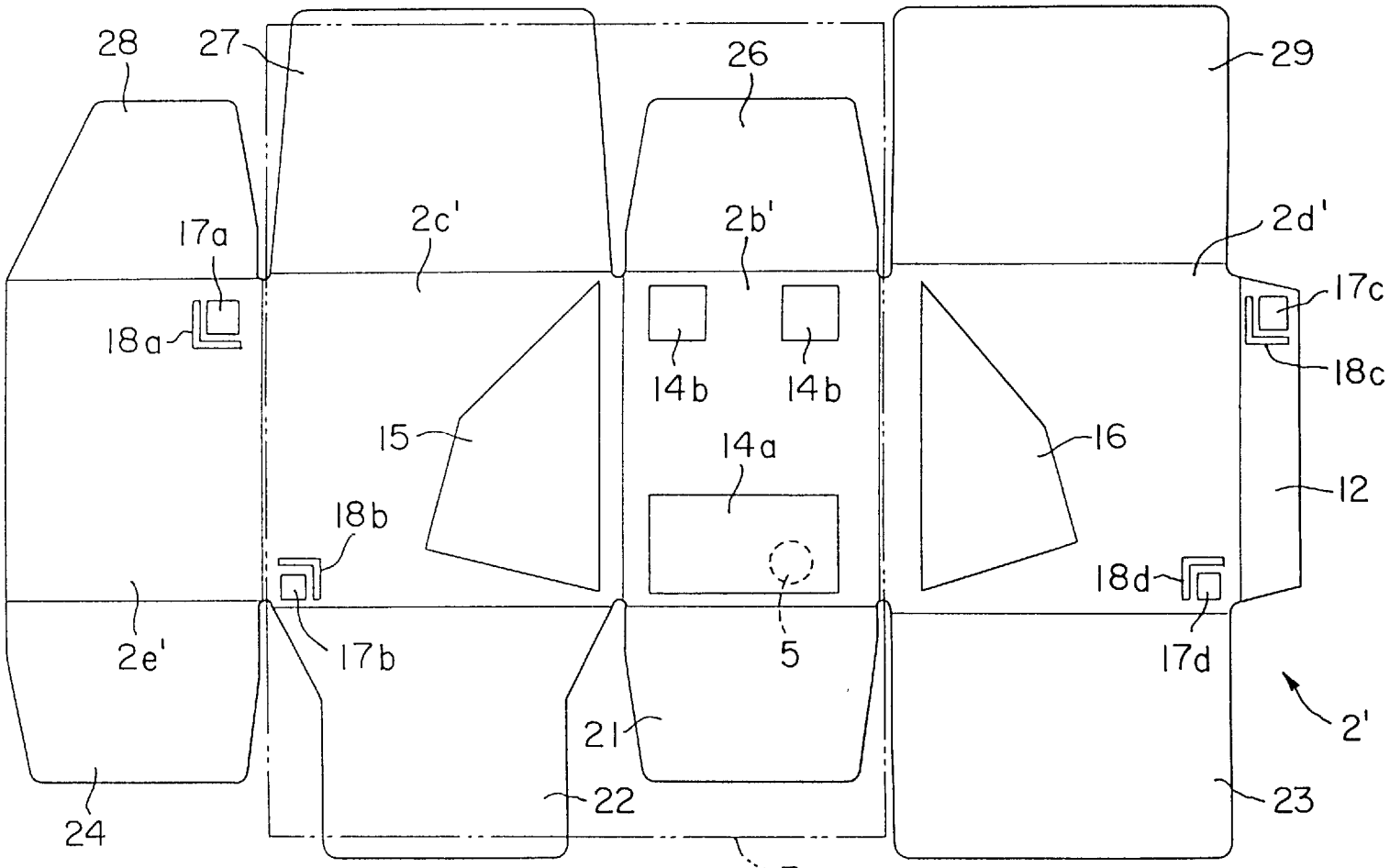
FIG. 6 is a view of a modification of the present invention, which corresponds to FIG. 1.
Figure 7:
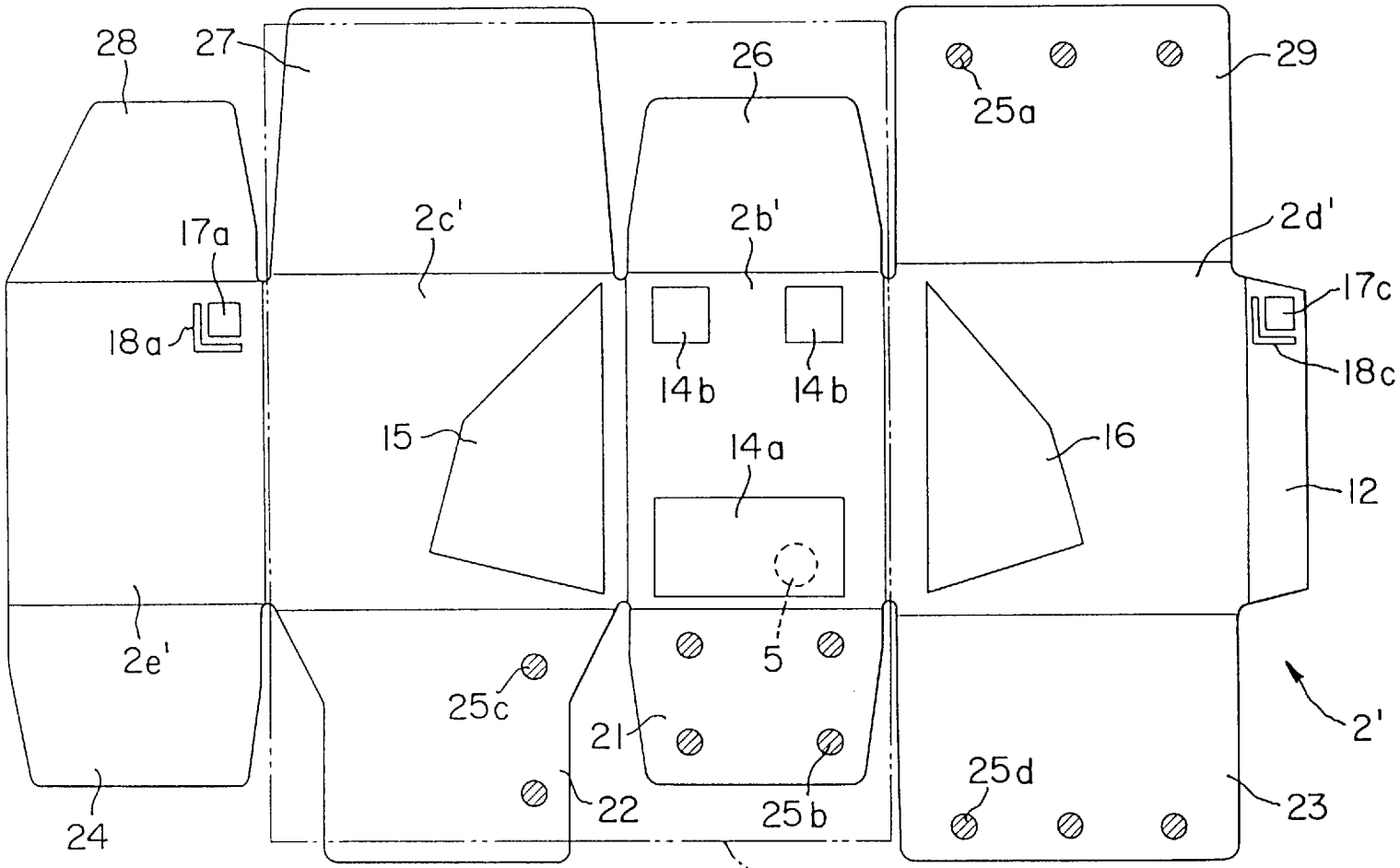
FIG. 7 is a view of the modification of the present invention, which corresponds to FIG. 2.
Figure 8:
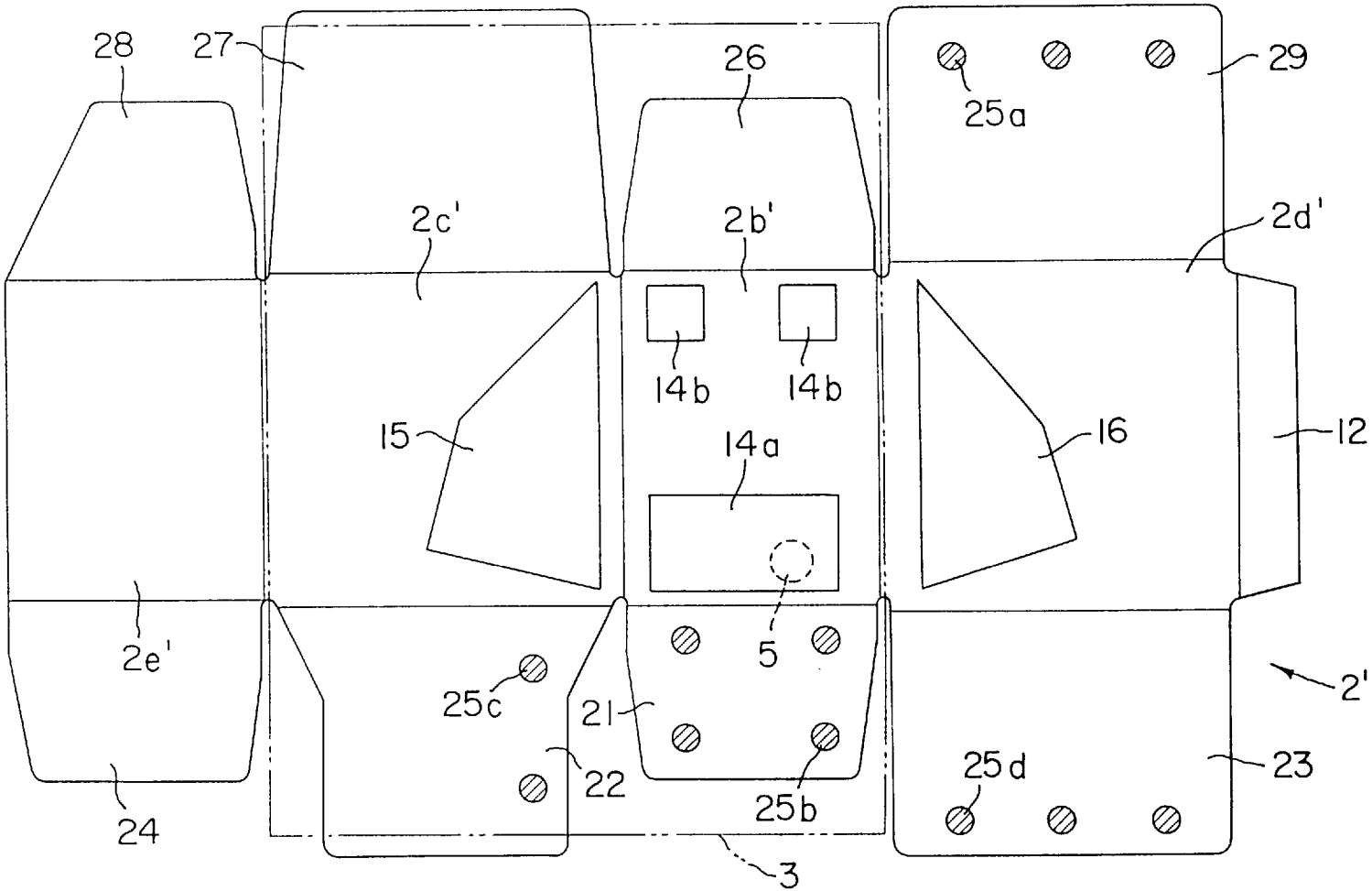
FIG. 8 is a view of the modification of the present invention, which corresponds to FIG. 3.

That is, in the embodiment of FIGS. 1 to 5, the inner bag 3 is adhered to the substantially entire region of the panel 2*b*, but as shown in FIGS. 6 to 8, the emulsion may be applied to three isolated regions 14*a*, 14*b*, 14*b* on the panel 2*b'*. The emulsion is thus applied separately to the three regions 14*a*, 14*b*, 14*b* on the panel 2*b'*, whereby the inner bag 3 can be fixed by the emulsion to the substantially entire region of the panel 2*b'* of the inner bag 3. Furthermore, a load to the panel 2*b'* can be decreased.

As shown in FIGS. 6 to 8, out of panels 21, 22, 23, 24 constituting a bottom surface 2*a*, the panel 22 and the panel 23 are positionally replaced by each other with respect to the embodiment of FIGS. 1 to 5. Out of panels 26, 27, 28, 29 constituting a top surface 2*f*, the panels 27 and the panel 29 are positionally replaced by each other with respect to the embodiment of FIGS. 1 to 5.

According to the present invention, when a material to be contained is loaded, the air in the inner bag can be drawn out without any air residue in the inner bag, and the air draw can be perfect. This makes load of the material into the inner bag efficient.

The half-cuts formed partially in the boundaries of the spot adhesion positions of the inner bag ensure the peeling of the inner bag. This ensures and facilitates the peeling of the inner bag.

Furthermore, when a content is discharged, the inner bag remains undeformed near the pouring spout. This keeps the inner bag from being deformed near the pouring spout, without adversely affecting the content.

When the carton blank is set up, the inner bag can be formed into a square shaft with high precision. Accordingly BIC with high precision can be produced.

The half-cuts formed partially in the boundaries of the spot adhesion positions of the inner bag ensure the peeling-off of the inner bag. This ensures and facilitates the peeling-off of the inner bag.

A part of the inner bag which is remotest from the pouring spout is fixed to the carton, whereby when the air in the inner bag is drawn, air residue can be prevented.

We claim:

1. A bag-in-carton comprising:

a closed box-shaped carton;

a flexible inner bag provided in the carton, for holding a content; and a pouring spout provided in a pouring spout attached surface of the carton, the inner bag being fixed to substantially the entire region of the pouring spout attached surface, and substantially half regions of a pair of opposed side surfaces bordering the pouring spout attached surface, the inner bag being fixed to the carton at a location remotest from the pouring spout and normal to the direction of movement made by the inner bag when air is drawn therefrom.

2. A bag-in-carton according to claim 1, wherein the portion of the inner bag located remotest from the pouring spout and normal to the direction of movement of the inner bag made when air is drawn therefrom, is spot fixed at two ends to the carton.

3. A bag-in-carton according to claim 2, wherein half-cuts are formed from an upper surface of those parts of the carton which are on boundaries of the inner bag that are spot fixed and cross a peeling direction of the inner bag, whereby the peeling-off of the inner bag is ensured by the half-cuts.

4. A bag-in-carton according to claim 3, wherein the spot fixed parts of the inner bags are square, and the half-cuts are provided on the side of the pouring spout and are L-shaped.

5. A bag-in-carton according to claim 1, wherein the pouring spout is provided on a boundary portion of the pouring spout attached surface, and the inner bag is fixed by being adhered to a surface bordering a side of the pouring spout, whereby a part of the inner bag corresponding to the surface bordering a side of the pouring spout remains undeformed when the content is discharged.

6. A bag-in-carton comprising:

a closed box-shaped carton;

a flexible inner bag provided in the carton, for holding a content; and a pouring spout provided in a pouring spout attached surface of the carton, the inner bag being fixed to substantially the entire region of the pouring spout attached surface, and substantially half regions of a pair of opposed side surfaces bordering the pouring spout attached surface, the pouring spout being provided in a boundary portion of the pouring spout attached surface, the inner bag being fixed by being adhered to a surface bordering a side of the pouring spout attached surface and being retained undeformed when the content is discharged.

7. A carton blank body comprising:

a carton blank; and a flexible inner bag provided on the carton blank, the inner bag being fixed to substantially the entire region of a pouring spout attached surface panel, and substantially half regions of a pair of opposed panels bordering the pouring spout attached surface panel.

8. A carton blank body according to claim 7, wherein the inner bag is fixed by being spot-adhered to four corners on the side of the panel opposing the pouring spout attached surface of the carton blank.

9. A carton blank body according to claim 7, wherein half-cuts formed from an upper surface of the carton into the carton are provided in parts of the carton blank which are boundaries of spot-adhered parts of the inner bag and normal to at least a direction of peeling of the inner bag, whereby the peeling-off of the inner bag is ensured by the half-cuts.

10. A carton blank body according to claim 9, wherein the spot-adhered parts of the inner bag are square-shaped, and the half-cuts are provided on the side of the pouring spout attached surface and formed in L-shape.

11. A carton blank body according to claim 7, wherein the inner bag is fixed by being adhered to a panel bordering the side of the pouring spout in the pouring spout attached surface.

* * * * *